US012098343B2

(12) United States Patent
Oda et al.

(10) Patent No.: US 12,098,343 B2
(45) Date of Patent: Sep. 24, 2024

(54) LUBRICANT ADDITIVE AND LUBRICANT COMPOSITION COMPRISING SAME

(71) Applicant: NOF CORPORATION, Shibuya-ku (JP)

(72) Inventors: Kazuhiro Oda, Nishinomiya (JP); Shunsuke Monjiyama, Nishinomiya (JP)

(73) Assignee: NOF CORPORATION, Shibuya-ku (JP)

( * ) Notice: Subject to any disclaimer, the term of this patent is extended or adjusted under 35 U.S.C. 154(b) by 0 days.

(21) Appl. No.: 17/764,900

(22) PCT Filed: Oct. 28, 2020

(86) PCT No.: PCT/JP2020/040459
§ 371 (c)(1),
(2) Date: Mar. 29, 2022

(87) PCT Pub. No.: WO2021/085480
PCT Pub. Date: May 6, 2021

(65) Prior Publication Data

US 2022/0396748 A1 Dec. 15, 2022

(30) Foreign Application Priority Data

Oct. 30, 2019 (JP) ..... 2019-196854

(51) Int. Cl.

| | |
|---|---|
| ***C10M 137/08*** | (2006.01) |
| ***C10M 169/04*** | (2006.01) |
| *C10N 20/02* | (2006.01) |
| *C10N 30/00* | (2006.01) |
| *C10N 30/06* | (2006.01) |

(52) U.S. Cl.
CPC ..... *C10M 137/08* (2013.01); *C10M 169/045* (2013.01); *C10M 2223/049* (2013.01); *C10N 2020/02* (2013.01); *C10N 2030/06* (2013.01); *C10N 2030/24* (2020.05)

(58) Field of Classification Search
CPC ..... C10M 169/045; C10M 137/02; C10M 141/10; C10M 137/08; C10M 2223/049; C10M 2203/1025; C10M 2219/024; C10M 2219/08; C10M 2209/103; C10M 2209/108; C10N 2030/06; C10N 2040/20; C10N 2020/02; C10N 2030/24; C10N 2040/25; C10N 2040/08
See application file for complete search history.

(56) References Cited

U.S. PATENT DOCUMENTS

| | | | | |
|---|---|---|---|---|
| 5,549,838 | A | 8/1996 | Miyagawa et al. | |
| 2009/0305922 | A1* | 12/2009 | Cha | C10M 169/04 508/421 |
| 2012/0270693 | A1 | 10/2012 | Ando et al. | |
| 2012/0277134 | A1 | 11/2012 | Deshimaru | |

FOREIGN PATENT DOCUMENTS

| | | | |
|---|---|---|---|
| CN | 102639685 | A | 8/2012 |
| CN | 104177405 | A | 12/2014 |
| JP | 2-32195 | A | 2/1990 |
| JP | 6-128580 | A | 5/1994 |
| JP | 7-258673 | A | 10/1995 |
| JP | 8-165483 | A | 6/1996 |
| JP | 2000-192067 | A | 7/2000 |
| JP | 2001-81490 | A | 3/2001 |
| JP | 2001-81491 | A | 3/2001 |
| JP | 2004-204002 | A | 7/2004 |
| JP | 2019-137829 | A | 8/2019 |
| WO | WO 2011/062282 | A1 | 5/2011 |
| WO | WO 2011/080970 | A1 | 7/2011 |

OTHER PUBLICATIONS

International Search Report mailed on Dec. 22, 2020 in PCT/JP2020/040459 filed on Oct. 28, 2020, (3 pages).
Combined Chinese Office Action and Search Report issued Sep. 23, 2022 in Chinese Patent Application No. 202080068954.X, 7 pages.

* cited by examiner

*Primary Examiner* — Vishal V Vasisth
(74) *Attorney, Agent, or Firm* — Oblon, McClelland, Maier & Neustadt, L.L.P.

(57) ABSTRACT

An additive for lubricating oil may include a phosphite ester compound (A) having a specific structure and a phosphite ester compound (B) having a specific structure, wherein the (A):(B) mass ratio of the phosphite ester compound (A) to the phosphite ester compound (B) is in a range of from 99:1 to 80:20. Such an additive may be provided to a lubricating oil, capable of imparting wear resistance and demulsibility with respect to a base oil for lubricating oil, and to impart durability even in the presence of water.

13 Claims, No Drawings

LUBRICANT ADDITIVE AND LUBRICANT COMPOSITION COMPRISING SAME

CROSS-REFERENCE TO RELATED APPLICATIONS

The present application is the national stage of international application PCT/JP2020/040459, filed on Oct. 28, 2020, and claims the benefit of the filing date of Japanese Appl. No. 2019-196854, filed on Oct. 30, 2019.

TECHNICAL FIELD

The present invention relates to an additive for lubricating oil and a lubricating oil composition containing the additive. More specifically, the present invention relates to an additive for lubricating oil capable of imparting wear resistance and demulsibility with respect to a base oil for lubricating oil (hereinafter also referred to as a base oil) and having excellent durability even in the presence of water, and a lubricating oil composition containing the additive.

BACKGROUND ART

Lubricating oils used in engine oils, hydraulic oils, metal working oils and the like are composed of base oils and additives having various functions. As a lubricating oil such as a metal working oil used under particularly severe conditions, an extreme pressure agent is used for the purpose of improving load resistance and wear prevention. Examples of the extreme pressure agent include chlorine-based, sulfur-based, and phosphorus-based extreme pressure agents.

However, although chlorine-based extreme pressure agents are excellent in extreme pressure properties, their use is avoided because they may cause skin irritation and deterioration of working environment such as metal rusting. In particular, chlorine-based extreme pressure agents tend to be avoided in applications where mists are generated, such as metal working oils. Sulfur-based compounds are also excellent in load resistance, but since many of them have a unique odor, they tend to be avoided for lubrication which may come into contact with the human body. Therefore, as a substitute for these chlorine-based and sulfur-based extreme pressure agents, phosphorus-based additives such as phosphoric acid ester (salt)-based additives are used. As such an additive, a compound such as an amine salt of a phosphate ester or a phosphite ester having an alkyl chain or a polyoxyalkylene chain is disclosed (PTL 1).

On the other hand, in the lubricating oil, water is mixed during use or storage, and there is a concern that problems such as a decrease in the ability to form an oil film and promotion of oxidative deterioration may occur. Therefore, the lubricating oil is required to have demulsibility (water separability) in which emulsification is difficult even when water is mixed in the lubricating oil during use, and separation of water is easy even when emulsification is performed. For example, PTL 2 discloses a lubricating oil composition in which a lubricating oil base oil is blended with a combination of a phosphate ester or a phosphite ester and a polyoxyalkylene monoalkyl ether for the purpose of improving demulsibility.

CITATION LIST

Patent Literature

[PTL 1] JP 2001-81491 A
[PTL 2] JP 6-128580 A

SUMMARY OF INVENTION

Technical Problem

However, although the lubricating oil composition described in PTL 2 has good initial demulsibility, the effect may decrease with time, and there has been a demand for a lubricating oil composition having good durability of demulsibility.

Further, even if the durability of demulsibility is good, the wear resistance of the lubricating oil mixed with water may decrease with time due to factors such as the occurrence of a change with time in the adsorption behavior to the metal surface due to the mixing of water. Since lubricating oil is desired to have a long life, it has been desired to develop an additive that exhibits wear resistance for a long time even when water is mixed into the lubricating oil.

As described above, an object of the present invention is to solve the above-described problems, and specifically to provide an additive for lubricating oil which can impart wear resistance and demulsibility with respect to a base oil for lubricating oil (hereinafter also referred to as a base oil), and is excellent in durability of demulsibility and wear resistance even in the presence of water, and a lubricating oil composition containing the additive.

Solution to Problem

As a result of intensive studies to solve the above-described problems, the present inventors have found that the above-described problems can be solved by including, in a base oil, an additive obtained by combining compounds represented by formula (1) and formula (2) at a specific amount ratio.

That is, the present invention includes the following [1] and [2].

[1] An additive for lubricating oil, comprising a phosphite ester compound (A) represented by formula (1) and a phosphite ester compound (B) represented by formula (2), wherein a mass ratio of the phosphite ester compound (A) to the phosphite ester compound (B) (phosphite ester compound (A):phosphite ester compound (B)) is 99:1 to 80:20:

Formula (1)

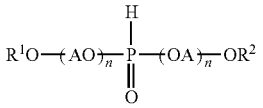

wherein, $R^1$ and $R^2$ each independently represent a hydrocarbon group having 1 to 22 carbon atoms, AO represents an oxyalkylene group having 2 to 4 carbon atoms, and n represents an average addition mole number of the oxyalkylene group and represents 0 to 5;

Formula (2)

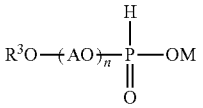

wherein, $R^3$ represents a hydrocarbon group having 1 to 22 carbon atoms, AO represents an oxyalkylene group having 2 to 4 carbon atoms, n represents an average addition mole number of the oxyalkylene group and represents 0 to 5, and M represents an organic ammonium.

[2] A lubricating oil composition containing 0.01 to 30% by mass of the additive for lubricating oil as set forth in [1].

Advantageous Effects of Invention

According to the present invention, it is possible to impart wear resistance and demulsibility with respect to a base oil for lubricating oil, and to impart the durability even in the presence of water.

DESCRIPTION OF EMBODIMENTS

Hereinafter, embodiments of the additive for lubricating oil of the present invention (hereinafter also referred to as "the present invention additive") and a lubricating oil composition containing the present invention additive and a base oil for lubricating oil will be described in detail.

In the description herein, a numerical range defined using an expression "to" includes numerical values of both ends (upper limit and lower limit) of "to". For example, "2 to 10" represents 2 or more and 10 or less.

[Additive for Lubricating Oil]

The present invention additive is an additive for lubricating oil, comprising a phosphite ester compound (A) represented by formula (1) and a phosphite ester compound (B) represented by formula (2), wherein a mass ratio of the phosphite ester compound (A) to the phosphite ester compound (B) (phosphite ester compound (A):phosphite ester compound (B)) is 99:1 to 80:20.

<Phosphite Ester Compound A>

The phosphite ester compound A is represented by the following formula.

Formula (1)

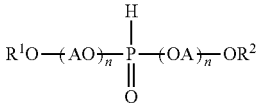

In the formula (1), $R^1$ and $R^2$ each independently represent a hydrocarbon group having 1 to 22 carbon atoms, and the hydrocarbon group may be saturated or unsaturated and may have a linear structure or a branched structure. $R^1$ and $R^2$ may be the same or different from each other.

Examples of $R^1$ include linear saturated hydrocarbon groups such as a methyl group, an ethyl group, a propyl group, a butyl group, a hexyl group, a heptyl group, an octyl group, a lauryl group, a myristyl group, a palmityl group, a stearyl group, and a behenyl group; branched saturated hydrocarbon groups such as an isopropyl group, an isobutyl group, a t-butyl group, an isopentyl group, an isooctyl group, a 2-ethylhexyl group, an isononyl group, a 3,5,5-trimethylhexyl group, an isodecyl group, an isostearyl group, a 2-octyldecyl group, a 2-octyldodecyl group, and a 2-hexyldecyl group; and unsaturated hydrocarbon groups such as a palmitoyl group, an oleyl group, and a linoleyl group. Examples of $R^2$ include the same groups as $R^1$ described above. One of these compounds having a hydrocarbon group may be used alone, or two or more thereof may be used in combination. When the number of carbon atoms is 23 or more, sufficient wear resistance may not be obtained.

From the viewpoint of wear resistance, $R^1$ and $R^2$ are preferably linear or branched saturated hydrocarbon groups or unsaturated hydrocarbon groups having 4 to 18 carbon atoms, and more preferably branched saturated hydrocarbon groups or unsaturated hydrocarbon groups having 8 to 18 carbon atoms. For example, a 2-ethylhexyl group, an isodecyl group, and an oleyl group are preferable, and a 2-ethylhexyl group is particularly preferable.

In the formula (1), AO is an oxyalkylene group having 2 to 4 carbon atoms, and may have either a linear structure or a branched structure. Examples of AO include an oxyethylene group, an oxypropylene group, an oxybutylene group, and an oxytetramethylene group. AO is preferably an oxyalkylene group having 2 to 3 carbon atoms, and more preferably an oxyethylene group having 2 carbon atoms.

In "AO" in the formula (1), A is an alkylene group having 2 to 4 carbon atoms, and O is an oxygen atom. Therefore, "AO" and "OA" in the formula (1) have the same meaning, and both mean the oxyalkylene group having 2 to 4 carbon atoms described above.

n represents an average addition mole number of the oxyalkylene group, and n is 0 to 5. When n is more than 5, wear resistance and demulsibility are deteriorated. From the viewpoint of wear resistance and demulsibility, n is preferably 2 or less, particularly preferably 1 or less, and particularly preferably 0.

When n is 0, it means that, in the formula (1), the oxygen atom of "$R^1O$" and the phosphorus atom are directly bonded to each other, and the oxygen atom of "$R^2O$" and the phosphorus atom are directly bonded to each other.

A method for producing the phosphite ester compound A represented by the formula (1) is not particularly limited, and examples thereof include a method in which a phosphorous acid and an alcohol are subjected to an esterification reaction at, for example, 80 to 180° C. The esterification reaction for producing the present ester compound is preferably carried out using an alcohol in an amount of at least 2 times the molar amount of the acid. Here, the alcohol to be reacted with the phosphorous acid is an alcohol having a hydrocarbon group having 1 to 22 carbon atoms or an ether group-containing alcohol obtained by adding an alkylene oxide to an alcohol having a hydrocarbon group having 1 to 22 carbon atoms.

<Phosphite Ester Compound B>

The phosphite ester compound B is represented by the following formula.

Formula (2)

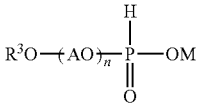

In the formula (2), $R^3$ represents a hydrocarbon group having 1 to 22 carbon atoms, and the hydrocarbon group may be saturated or unsaturated and may have a linear structure or a branched structure. Examples of $R^3$ include linear saturated hydrocarbon groups such as a methyl group, an ethyl group, a propyl group, a butyl group, a hexyl group, a heptyl group, an octyl group, a lauryl group, a myristyl group, a palmityl group, a stearyl group, and a behenyl group; branched saturated hydrocarbon groups such as an isopropyl group, an isobutyl group, a t-butyl group, an isopentyl group, an isooctyl group, a 2-ethylhexyl group, an isononyl group, a 3,5,5-trimethylhexyl group, an isodecyl group, an isostearyl group, a 2-octyldecyl group, a 2-octyldodecyl group, and a 2-hexyldecyl group, and unsaturated hydrocarbon groups such as a palmitoyl group, an oleyl group; and a linoleyl group. When the number of carbon atoms is 23 or more, sufficient wear resistance may not be obtained.

From the viewpoint of wear resistance, $R^3$ is preferably linear or branched saturated hydrocarbon groups or unsaturated hydrocarbon groups having 4 to 18 carbon atoms, and more preferably branched saturated hydrocarbon groups or unsaturated hydrocarbon groups having 8 to 18 carbon atoms. For example, a 2-ethylhexyl group, an isodecyl group, and an oleyl group are preferable, and a 2-ethylhexyl group is particularly preferable.

In the formula (2), AO is an oxyalkylene group having 2 to 4 carbon atoms, and may have either a linear structure or a branched structure. Examples of AO include an oxyethylene group, an oxypropylene group, an oxybutylene group, and an oxytetramethylene group. AO is preferably an oxyalkylene group having 2 to 3 carbon atoms, and more preferably an oxyethylene group having 2 carbon atoms.

n represents an average addition mole number of the oxyalkylene group, and n is 0 to 5. When n is more than 5, wear resistance and demulsibility are deteriorated. From the viewpoint of wear resistance and demulsibility, n is preferably 2 or less, particularly preferably 1 or less, and particularly preferably 0.

When n is 0, it means that the oxygen atom of "$R^3O$" and the phosphorus atom in the formula (2) are directly bonded to each other.

M represents an organic ammonium. M is an organic ammonium in which a saturated or unsaturated hydrocarbon group having 1 to 24 carbon atoms is bonded to a nitrogen atom, and the hydrocarbon group may have either a linear structure or a branched structure. At least one hydrocarbon group among the hydrocarbon groups of the organic ammonium is preferably a hydrocarbon group having 12 to 24 carbon atoms, and more preferably a hydrocarbon group having 18 to 24 carbon atoms. Among the hydrocarbon groups of the organic ammonium, one hydrocarbon group is preferably a hydrocarbon group having 12 to 24 carbon atoms, and more preferably a hydrocarbon group having 18 to 24 carbon atoms.

The hydrocarbon groups may also be identical to one another, or at least one hydrocarbon group may be different. Examples of the organic ammonium include octyl ammonium, lauryl ammonium, oleyl ammonium, stearyl ammonium, dioctyl ammonium, triethylamine, trioctylamine, dimethyllaurylamine, and dimethylstearylamine. From the viewpoint of demulsibility and durability, the organic ammonium is preferably lauryl ammonium, oleyl ammonium, dimethyl lauryl ammonium, or trioctyl ammonium having a total carbon number of 12 or more, and more preferably oleyl ammonium having a total carbon number of 18 or more.

Next, a method for producing the phosphite ester compound B represented by the above formula (2) will be described.

The method for producing the phosphite ester compound B represented by the formula (2) is not particularly limited. For example, the phosphorous acid monoester amine salt represented by the formula (2) can be produced by a first step of producing a phosphorous acid monoester and a second step of neutralizing the phosphorous acid monoester obtained in the first step with an amine compound.

The first step will be described.

Examples of the first step include a method in which an alcohol having a hydrocarbon group having 1 to 22 carbon atoms or an ether group-containing alcohol obtained by adding an alkylene oxide to the alcohol is subjected to an esterification reaction with phosphorous acid at, for example, 80 to 180° C.

Next, the second step will be described.

In the second step, the phosphorus acid monoester produced in the first step and an amine compound are subjected to a neutralization reaction at, for example, 20 to 60° C. to produce the compound. From the viewpoint of stability with time, the molar ratio of the phosphorous acid monoester to the amine compound is preferably in the range of 60:40 to 40:60, more preferably in the range of 55:45 to 45:55, and still more preferably in the range of 52:48 to 48:52.

In the additive for lubricating oil of the present invention, the mass ratio between the phosphite ester compound A and the phosphite ester compound B (phosphite ester compound A:phosphite ester compound B) is 99:1 to 80:20. If the content of the phosphite ester compound A in the additive for lubricating oil is more than 99% by mass, wear resistance and durability of the wear resistance become poor, and when it is less than 80% by mass, demulsibility, durability of the demulsibility, and durability of the wear resistance become poor.

The mass ratio of the phosphite ester compound A to the phosphite ester compound B (phosphite ester compound A:phosphite ester compound B) is preferably 99:1 to 90:10.

By using the additive for lubricating oil of the present invention described above in combination with a sulfur-based extreme pressure agent, that is, by using an additive composition comprising the additive for lubricating oil and a sulfur-based extreme pressure agent, the load resistance can be synergistically improved. Examples of the sulfur-based extreme pressure agent include sulfurized fatty acids, sulfurized fats and oils, and polysulfides, and one type thereof may be used alone, or two or more types thereof may be used in combination.

The sulfurized fatty acids refer to sulfides of fatty acids, and examples of commercially available sulfurized fatty acids include DAILUBE GS-550 (manufactured by DIC Corporation) and Additin RC2715 (manufactured by Rhein Chemie).

Sulfurized fats and oils are also referred to as sulfurized esters, and refer to fatty acid glycerin esters and sulfides of fatty acid esters. Examples of commercially available sulfurized fats and oils or sulfurized esters include DAILUBE GS-110, DAILUBE GS-240, DAILUBE GS-215, DAILUBE GS-225, and DAILUBE GS-245 (all manufactured by DIC Corporation), and Additin RC2310 and Additin RC2415 (all manufactured by Rhein Chemie).

Polysulfide refers to a compound represented by the general formula R—Sn—R' (wherein R and R' may be the same as or different from each other, and represent a hydrocarbon group such as a linear or branched alkyl group, and n is a number of 2 or more). Examples of commercially available polysulfides include DAILUBE IS-30, DAILUBE IS-35, and DAILUBE GS-420 (all manufactured by DIC Corporation), and Additin RC2540 and Additin RC2541 (all manufactured by Rhein Chemie).

From the viewpoint of a synergistic effect of load resistance, sulfurized fats and oils and polysulfides are preferable.

The mixing ratio of the phosphite ester compounds A and B and the sulfur-based extreme pressure agent in the additive composition is such that the content of the sulfur-based extreme pressure agent is 1 to 1,000 parts by mass, and preferably 10 to 500 parts by mass, with respect to 100 parts by mass of the total content of the phosphite ester compound A and the phosphite ester compound B.

[Lubricating Oil Composition]

The lubricating oil composition of the present invention contains the present invention additive and a base oil for lubricating oil.

As the base oil for lubricating oil in the present invention, various base oils for lubricating oil can be used. Examples thereof include conventionally used base oils for lubricating oils, such as mineral oils, highly purified mineral oils, animal and vegetable fats and oils, synthetic esters, poly-α-olefins, and GTL (Gas To Liquid) oils.

The content of the present invention additive in the lubricating oil composition of the present invention is 0.01 to 30% by mass, preferably 0.05 to 20% by mass, and more preferably 0.1 to 10% by mass. When the content of the present invention additive is too small, sufficient wear resistance may not be obtained. On the other hand, when the content of the present invention additive is too large, wear resistance, demulsibility, and the durability corresponding to the added amount may not be obtained.

The lubricating oil composition of the present invention may contain an additive composition and a base oil for lubricating oil. The additive composition is a composition comprising an additive for lubricating oil and a sulfur-based extreme pressure agent as described above.

The content of the additive composition in the lubricating oil composition is 0.02 to 60% by mass, preferably 0.1 to 40% by mass, and more preferably 0.2 to 20% by mass. When the content of the additive composition is equal to or more than these lower limits, demulsibility, load resistance, and the durability thereof can be improved. When the content of the additive composition is equal to or less than these upper limits, it is easy to obtain demulsibility, load resistance, and the durability thereof corresponding to the addition amount.

The content of the base oil for lubricating oil in the lubricating oil composition of the present invention is 70 to 99.99% by mass, preferably 80 to 99.95% by mass, and more preferably 90 to 99.9% by mass.

The lubricating oil composition of the present invention may contain other additives such as a detergent dispersant, a viscosity index improver, a rust inhibitor, a corrosion inhibitor, a pour point depressant, and a metal deactivator, if necessary.

EXAMPLES

Hereinafter, the present invention will be described in more detail with reference to Examples and Comparative Examples. Synthesis Examples 1 to 3 below show synthesis examples of a phosphite ester compound A represented by the formula (1), Synthesis Examples 4 to 6 below show synthesis examples of a phosphite ester compound B represented by the formula (2), and Production Example 1 below shows a production example of an additive 1 composed of the phosphite ester compound A and the phosphite ester compound B.

Synthesis Example 1, Compound 1-A of Formula (1)

A thermometer and a nitrogen inlet tube were inserted into a 1 L four-necked flask, 533 g (4.1 mol) of 2-ethylhexanol and 164 g (2 mol) of phosphorous acid were charged, and the reaction was carried out at 120° C. under a reduced pressure of 200 Torr or less. The reaction was terminated when the amount of decrease in acid value per hour became 0.5 mgKOH/g or less. After completion of the reaction, the unreacted raw material was removed at 150° C. under a reduced pressure of 30 Torr or less to obtain the compound of the formula (1).

Synthesis Example 1', Compound 1-B of Formula (1)

Compound 1-B of the formula (1) shown in Table 1 was synthesized in accordance with Synthesis Example 1 by appropriately changing 2-ethylhexanol in Synthesis Example 1 to isodecanol.

Synthesis Example 2, Compound 1-C of Formula (1)

780 g (6 mol) of 2-ethylhexanol and 1.3 g of potassium hydroxide were charged in a 5-liter stainless steel pressure-resistant container equipped with a stirrer, a pressure gauge, a thermometer, a safety valve, a gas blowing pipe, an exhaust pipe, a cooling coil, and a steam jacket, and after nitrogen substitution, the temperature was raised to 120° C. while stirring. Under stirring, 530 g (12 mol) of ethylene oxide was added from a pressure-resistant container prepared separately under the conditions of 120° C. and 0.05 to 0.50 MPa (gauge pressure) while being pressurized by nitrogen gas through the gas blowing pipe. After completion of the addition, the reaction was continued under the same conditions until the internal pressure became constant. Thereafter, the reaction product was taken out from the pressure-resistant container, neutralized with hydrochloric acid to adjust a pH of 6 to 7, subjected to a pressure reduction treatment at 100° C. for 1 hour in order to remove the contained water, and finally, the salt was removed by filtration to obtain 1250 g of an ether group-containing alcohol. The obtained ether group-containing alcohol had a hydroxyl value of 255, and the molecular weight obtained from the hydroxyl value was 220.

Next, 462 g (2.1 mol) of the ether group-containing alcohol obtained above and 82 g (1 mol) of phosphorous acid were charged into a 1-liter glass reaction vessel equipped with a stirrer, a thermometer, and a nitrogen inlet tube, and the reaction was carried out at 120° C. under a reduced pressure of 200 Torr or less. The reaction was terminated when the amount of decrease in acid value per hour became 0.5 mgKOH/g or less. After completion of the reaction, the unreacted raw material was removed at 200° C. under a reduced pressure of 30 Torr or less to obtain Compound 1-C.

Synthesis Example 3, Compound 1-D

Compound 1-D was obtained in the same manner as in Synthesis Example 2, except that 2-ethylhexanol in Synthesis Example 2 was changed to butanol.

TABLE 1

| Compound | R1 | R2 | AO | n |
|---|---|---|---|---|
| 1-A (Phosphite ester compound A) | 2-ethylhexyl | 2-ethylhexyl | — | 0 |
| 1-B (Phosphite ester compound A) | isodecyl | isodecyl | — | 0 |
| 1-C (Phosphite ester compound A) | 2-ethylhexyl | 2-ethylhexyl | oxyethylene | 2 |

TABLE 1-continued

| Compound | R1 | R2 | AO | n |
|---|---|---|---|---|
| 1-D (Comparative compound of compound A) | butyl | butyl | oxyethylene | 7 |

Synthesis Example 4, Compound 2-A of Formula (2)

A thermometer and a nitrogen inlet tube were inserted into a 1 L four-necked flask, 260 g (2 mol) of 2-ethylhexanol and 180 g (2.2 mol) of phosphorous acid were charged, and the reaction was carried out at 120° C. under a reduced pressure of 200 Torr or less. The reaction was terminated when the amount of decrease in acid value per hour became 0.5 mgKOH/g or less. Thereafter, ion-exchanged water in an amount corresponding to 20% by mass with respect to the reaction solution was added thereto, and the mixture was stirred at 60° C. for 10 minutes and allowed to stand for 10 minutes to remove the separated aqueous layer. Thereafter, the mixture was dehydrated by stirring at 100° C. and 30 Torr for 1 hour. After the dehydration, 535 g (2 mol) of oleylamine was added thereto, and the mixture was stirred and mixed at 25° C. for 0.5 hours to obtain Compound 2-A of the formula (2).

Compounds 2-B and 2-D of the formula (2) shown in Table 2 were synthesized in accordance with Synthesis Example 4 by appropriately changing 2-ethylhexanol and oleylamine in Synthesis Example 4 to other compounds.

Synthesis Example 5, Compound 2-C of Formula (2)

440 g (2 mol) of the ether group-containing alcohol obtained in Synthesis Example 2 and 180 g (2.2 mol) of phosphorous acid were charged into a 1-liter glass reaction vessel equipped with a stirrer, a thermometer, and a nitrogen inlet tube, and the reaction was carried out at 120° C. under a reduced pressure of 200 Torr or less. The reaction was terminated when the amount of decrease in acid value per hour became 0.5 mgKOH/g or less. Thereafter, ion-exchanged water in an amount corresponding to 20% by mass with respect to the reaction solution was added thereto, and the mixture was stirred at 60° C. for 10 minutes and allowed to stand for 10 minutes to remove the separated aqueous layer. Thereafter, the mixture was dehydrated by stirring at 100° C. and 30 Torr for 1 hour. After the dehydration, 535 g (2 mol) of oleylamine was added thereto, and the mixture was stirred and mixed at 25° C. for 0.5 hours to obtain Compound 2-C.

Synthesis Example 6, Compound 2-E

Compound 2-E was obtained in the same manner as in Synthesis Example 2 and Synthesis Example 5, except that 2-ethylhexanol in Synthesis Example 2 was changed to butanol.

TABLE 2

| Compound | R3 | AO | n | M |
|---|---|---|---|---|
| 2-A (Phosphite ester compound B) | 2-ethylhexyl | — | 0 | oleyl ammonium |
| 2-B (Phosphite ester compound B) | isodecyl | — | 0 | dimethyllauryl ammonium |
| 2-C (Phosphite ester compound B) | 2-ethylhexyl | oxyethylene | 2 | oleyl ammonium |
| 2-D (Comparative compound of compound B) | 2-ethylhexyl | — | 0 | hydrogen atom |
| 2-E (Comparative compound of compound B) | butyl | oxyethylene | 7 | oleyl ammonium |

Blending Example 1, Additive 1

A thermometer and a nitrogen inlet tube were inserted into a 1 L four-necked flask, and 500 g of Compound 1-A synthesized in Synthesis Example 1 and 10 g of Compound 2-A synthesized in Synthesis Example 4 were stirred and blended at 25° C. for 0.5 hours to obtain Additive 1.

Additives 2 to 7 shown in Table 3 were obtained by appropriately changing the blending ratio of the compound of the formula (1) and the compound of the formula (2) in Blending Example 1 and performing operations in accordance with Blending Example 1.

TABLE 3

| | Blending ratio (Mass ratio) | | | | | | | | |
|---|---|---|---|---|---|---|---|---|---|
| | Phosphite ester compound A | | | Comparative compound of compound A | Phosphite ester compound B | | | Comparative compound of compound B | |
| Additive | 1-A | 1-B | 1-C | 1-D | 2-A | 2-B | 2-C | 2-D | 2-E |
| 1 | 98 | | | | 2 | | | | |
| 2 | | 94 | | | | 6 | | | |
| 3 | | | 88 | | | | 12 | | |
| 4 | 98 | | | | | | | 2 | |
| 5 | 100 | | | | | | | | |
| 6 | 60 | | | | 40 | | | | |
| 7 | | | | 85 | | | | | 15 |

Blending Example 2, Preparation of Lubricating Oil Composition 1

Lubricating oil compositions of Examples (1-1) to (1-3) and Comparative Examples (1-1) to (1-4) were obtained by blending 0.5% by mass of the above-described Additives 1 to 7 with respect to a base oil for lubricating oil (poly-α-olefin, kinematic viscosity (40° C.): about 50 $mm^2/s$). The obtained lubricating oil compositions (test oils) were subjected to the following evaluation tests. The evaluation results are shown in Table 4 below.

(Wear Resistance Test)

The wear resistance was evaluated using an SRV tester (manufactured by OPTIMOL, Model 4 Schwingungs Reihungundund Verschleiss tester). The SRV test was performed with a ball/disk, and each test piece used was made of SUJ-2. The test conditions were a test temperature of 120° C., a load of 100N, an amplitude of 1 mm, and a frequency of 50 Hz, and the wear scar diameter was measured after the test time of 25 min had elapsed.

The evaluation was made as follows: AA: less than 350 μm, A: 350 μm or more and less than 400 μm, and C: 400 μm or more.

In addition, a 100-mL glass bottle was charged with 100 mL of the lubricating oil composition and 0.1 mL of water, sealed in an air atmosphere, and allowed to stand in a thermostatic chamber at 40° C. for 7 days. The wear resistance of the lubricating oil composition was measured under the same conditions.

(Demulsibility Test)

The demulsibility was evaluated in accordance with JIS K 2520. The separation time of oil and water was evaluated as follows. The evaluation was as follows: A: separation time was less than 5 minutes, C: separation time was 5 minutes or more.

In addition, a 100-mL glass bottle was charged with 100 mL of the lubricating oil composition and 0.1 mL of water, sealed in an air atmosphere, and allowed to stand in a thermostatic chamber at 40° C. for 7 days. The evaluation of the demulsibility of the lubricating oil composition was measured under the same conditions.

As is clear from the results shown in Table 4, it can be seen that Additives 1 to 3 according to the present invention can impart wear resistance and demulsibility with respect to the base oil for lubricating oil, and have excellent durability even in the presence of water.

On the other hand, in Additive 4 in which M was out of the range, the wear resistance and the demulsibility immediately after preparation were good, but the durability was poor. Additives 5 and 6, which are out of the range of the formula (1) or the formula (2), were inferior in the wear resistance and the demulsibility immediately after preparation. Additive 7 in which n was out of the range was inferior in the wear resistance and the demulsibility immediately after preparation, and the durability was also inferior.

Next, preparation examples of the additive compositions containing the compound (1-A) of the formula (1) shown in Table 1, the compound (2-A) or (2-D) of the formula (2) shown in Table 2, and the following sulfur-based extreme pressure agent are shown in the following Blending Example 3. Further, preparation examples of the lubricating oil compositions containing the additive compositions prepared in Blending Example 3 are shown in the following Blending Example 4.

[Sulfur-Based Extreme Pressure Agent]

As the sulfur-based extreme pressure agent, DAILUBE GS-240 and DAILUBE IS-30 manufactured by DIC Corporation were used. Compound C-1 is DAILUBE GS-240 and Compound C-2 is DAILUBE IS-30.

Blending Example 3, Preparation of Additive Compositions

A thermometer and a nitrogen inlet tube were inserted into a 300 mL to 1 L four-necked flask, and the additives shown in Table 5 were stirred and mixed at 25° C. for 1 hour to obtain the additive compositions 1 to 6.

TABLE 4

| | | | Example 1-1 | Example 1-2 | Example 1-3 | Comparative Example 1-1 | Comparative Example 1-2 | Comparative Example 1-3 | Comparative Example 1-4 |
|---|---|---|---|---|---|---|---|---|---|
| Type of additive used | | | Additive 1 | Additive 2 | Additive 3 | Additive 4 | Additive 5 | Additive 6 | Additive 7 |
| Content of additive (% by mass) | | | 0.5 | 0.5 | 0.5 | 0.5 | 0.5 | 0.5 | 0.5 |
| Content of base oil for lubricating oil (% by mass) | | | 99.5 | 99.5 | 99.5 | 99.5 | 99.5 | 99.5 | 99.5 |
| Demulsibility | No water addition | Immediately after | A | A | A | A | A | C | C |
| | 0. 1% addition of water | 40° C., after 7 days | A | A | A | C | A | C | C |
| Wear resistance (μm) | No water addition | Immediately after | AA (320) | AA (330) | AA (335) | AA (325) | C (430) | AA (340) | C (420) |
| | 0. 1% addition of water | 40° C., after 7 days | AA (325) | AA (340) | A (355) | C (410) | C (440) | C (415) | C (440) |

TABLE 5

| Additive composition | Blending ratio (Mass ratio) Phosphite ester compound A 1-A | Phosphite ester compound B 2-A | 2-D | Sulfur-based extreme pressure agent C C-1 | C-2 | Blending ratio (Mass ratio) A:B | (A + B):C |
|---|---|---|---|---|---|---|---|
| 1 | 95 | 5 | — | 100 | — | 95:5 | 100:100 |
| 2 | 95 | 5 | — | 300 | — | 95:5 | 100:300 |
| 3 | 95 | 5 | — | 25 | — | 95:5 | 100:25 |
| 4 | 95 | 5 | — | — | 100 | 95:5 | 100:100 |
| 5 | 95 | — | 5 | 100 | — | 95:5 | 100:100 |
| 6 | — | — | — | 100 | | — | 0:100 |

Blending Example 4, Preparation of Lubricating Oil Compositions 2

With respect to a base oil for lubricating oil (mineral oil, kinematic viscosity (40° C.): about 20 $mm^2/s$), 10% by mass of the additive compositions 1 to 6 shown in Table 5 were blended to obtain the lubricating oil compositions of Examples (2-1) to (2-4) and Comparative Examples (2-1) and (2-2). The obtained lubricating oil compositions (test oils) were subjected to the following evaluation tests. The evaluation results are shown in Table 6 below.

(Load Resistance Test)

The seizure load was evaluated by a Shell Four Ball Tester. A test piece made of SUJ-2 was used. The test conditions were a test temperature of 25° C., a rotational speed of 1,800 rpm, and a test time of 10 seconds, and the load was applied in the order of 50 kg, 63 kg, 80 kg, 100 kg, 126 kg, 160 kg, and 200 kg. The seizure load was defined as the load at which seizure streaks were formed on the wear surface due to phenomena such as rapid increase in friction torque and occurrence of abnormal noise during the test.

The evaluation was made as follows: AA: 160 kg or more, A: 126 kg or more and less than 160 kg, C: less than 126 kg.

In addition, a 100-mL glass bottle was charged with 100 mL of the lubricating oil composition and 0.1 mL of water, sealed in an air atmosphere, and allowed to stand in a thermostatic chamber at 40° C. for 7 days. The load resistance of the lubricating oil composition was measured under the same conditions.

(Demulsibility Test)

The demulsibility was evaluated in accordance with JIS K 2520. The separation time of oil and water was evaluated as follows. The evaluation was as follows: A: separation time was less than 5 minutes, C: separation time was 5 minutes or more.

In addition, a 100-mL glass bottle was charged with 100 mL of the lubricating oil composition and 0.1 mL of water, sealed in an air atmosphere, and allowed to stand in a thermostatic chamber at 40° C. for 7 days. The evaluation of the demulsibility of the lubricating oil composition was measured under the same conditions.

TABLE 6

| | | | Example 2-1 | Example 2-2 | Example 2-3 | Example 2-4 | Comparative Example 2-1 | Comparative Example 2-2 |
|---|---|---|---|---|---|---|---|---|
| Type of additive composition used | | | Additive Composition 1 | Additive Composition 2 | Additive Composition 3 | Additive Composition 4 | Additive Composition 5 | Additive Composition 6 |
| Content of additive composition (% by mass) | | | 10 | 10 | 10 | 10 | 10 | 10 |
| Content of base oil for lubricating oil (% by mass) | | | 90 | 90 | 90 | 90 | 90 | 90 |
| Demulsibility | No water addition | Immediately after | A | A | A | A | A | A |
| | 0. 1% addition of water | 40° C., after 7 days | A | A | A | A | C | A |
| Load resistance (kg) | No water addition | Immediately after | AA (200) | AA (200) | AA (160) | AA (160) | AA (200) | C (100) |
| | 0. 1% addition of water | 40° C., after 7 days | AA (200) | AA (160) | A (126) | AA (160) | C (100) | C (80) |

As is clear from the results shown in Table 6, it can be seen that the lubricating oil compositions (2-1) to (2-4) of Examples (2-1) to (2-4) using the additive compositions 1 to 4 according to the present invention can impart excellent load resistance and demulsibility and are excellent in the durability even in the presence of water.

On the other hand, in Comparative Example (2-1) using the additive composition 5 in which M was out of the range, the initial load resistance and the initial demulsibility were excellent, but the durability was poor. In addition, in Comparative Example (2-2) using the additive composition 6 composed of only the sulfur-based extreme pressure agent, sufficient load resistance was not obtained.

The invention claimed is:

1. A lubricating oil composition, comprising:

a base oil; and an additive suitable for a lubricating oil, the additive comprising:

a phosphite ester compound (A) of formula (1)

(1)

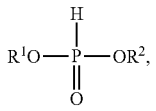

$R^1$ and $R^2$ each independently being a branched saturated hydrocarbon group having 8 to 18 carbon atoms; and a phosphite ester compound (B) of formula (2)

(2)

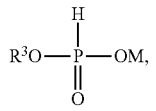

$R^3$ being a branched saturated hydrocarbon group having 8 to 18 carbon atoms, and M being an organic ammonium in which a saturated or unsaturated hydrocarbon group having 18 carbon atoms is bonded to a nitrogen atom, wherein an (A):(B) mass ratio of the phosphite ester compound (A) to the phosphite ester compound (B) is in a range of from 99:1 to 88:12, wherein the additive is present in a range of from 0.5 to 10% by mass, based on total lubricating oil composition mass, and wherein the base oil is present in a range of from 90 to 99.5% by mass, based on total lubricating oil composition mass.

2. The lubricating oil composition of claim 1, wherein, in the phosphite ester compound (B), $R^3$ is isooctyl, 2-ethylhexyl, isononyl, 3,5,5- trimethylhexyl, isodecyl, isostearyl, 2-octyldecyl, or 2-hexyldecyl.

3. The lubricating oil composition of claim 1, wherein the (A):(B) mass ratio is in a range of from 98:2 to 88:12.

4. The lubricating oil composition of claim 1, wherein, in the phosphite ester compound (A), $R^1$ and $R^2$ are independently isooctyl, 2-ethylhexyl, isononyl, 3,5,5-trimethylhexyl, isodecyl, isostearyl, 2-octyldecyl, 2-octyldodecyl, 2-hexyldecyl group, palmitoyl, oleyl, or linoleyl, and wherein, in the phosphite ester compound (B), $R^3$ is 2-ethylhexyl, isodecyl, or oleyl.

5. The lubricating oil composition of claim 1, wherein, in the phosphite ester compound (B), M is oleyl ammonium.

6. The lubricating oil composition of claim 1, wherein the (A):(B) mass ratio is in a range of from 99:1 to 90:10.

7. The lubricating oil composition of claim 1, further comprising:

a sulfur-based extreme pressure agent.

8. The lubricating oil composition of claim 7, wherein the sulfur-based extreme pressure agent comprises a sulfurized fat, sulfurized oil, and/or polysulfide.

9. The lubricating oil composition of claim 7, wherein the sulfur-based extreme pressure agent is present in a range of from 1 to 1,000 parts by mass, with respect to 100 parts by mass of a total mass of the phosphite ester compound A and the phosphite ester compound B.

10. The lubricating oil composition of claim 7, wherein the sulfur-based extreme pressure agent is present in a range of from 10 to 500 parts by mass, with respect to 100 parts by mass of a total mass of the phosphite ester compound A and the phosphite ester compound B.

11. The lubricating oil composition of claim 1, consisting of the base oil, the additive, and the sulfur-based extreme pressure agent, and optionally, at least one selected from the group consisting of a dispersant, a viscosity index improver, a rust inhibitor, a corrosion inhibitor, a pour point depressant, a metal deactivator, and a mixture thereof.

12. The lubricating oil composition of claim 1, wherein the hydrocarbon groups of $R^1$, $R^2$, and $R^3$ independently have 8 to 10 carbon atoms.

13. The lubricating oil composition of claim 1, wherein the hydrocarbon groups of $R^1$, $R^2$, and $R^3$ are independently 2-ethylhexyl or isodecyl.

* * * * *